US011111708B2

(12) United States Patent
Kruedener et al.

(10) Patent No.: US 11,111,708 B2
(45) Date of Patent: Sep. 7, 2021

(54) DEVICE FOR MOVING A FURNITURE PART THAT IS RECEIVED ON A FURNITURE CABINET OF AN ITEM OF FURNITURE

(71) Applicant: Grass GmbH, Reinheim (DE)

(72) Inventors: Boris Kruedener, Kleinostheim (DE); Markus Herper, Mühltal (DE)

(73) Assignee: Grass GmbH, Reinheim (DE)

( * ) Notice: Subject to any disclaimer, the term of this patent is extended or adjusted under 35 U.S.C. 154(b) by 6 days.

(21) Appl. No.: 16/381,356

(22) Filed: Apr. 11, 2019

(65) Prior Publication Data

US 2019/0316394 A1 Oct. 17, 2019

(30) Foreign Application Priority Data

Apr. 17, 2018 (DE) ..... 20 2018 102 089.7

(51) Int. Cl.
*E05D 3/06* (2006.01)
*E05D 11/00* (2006.01)

(52) U.S. Cl.
CPC ..... *E05D 3/06* (2013.01); *E05D 11/0054* (2013.01); *E05Y 2201/47* (2013.01); *E05Y 2800/116* (2013.01); *E05Y 2900/20* (2013.01)

(58) Field of Classification Search
CPC ... E05D 3/06; E05D 11/0054; Y10T 16/5285; Y10T 16/53838
See application file for complete search history.

(56) References Cited

U.S. PATENT DOCUMENTS 3,469,277 A * 9/1969 Brown ..... E05F 1/1215 16/324
3,952,367 A * 4/1976 Schnelle ..... E05D 11/1014 16/253
7,080,428 B2 * 7/2006 Hyde ..... E05D 7/1061 16/231

(Continued)

FOREIGN PATENT DOCUMENTS

EP 2 459 829 B1 8/2013
WO 2011/011800 A2 2/2011
WO 2017/219054 A1 12/2017

OTHER PUBLICATIONS

Extended European Search Report (Application No. 19168351.5) dated Sep. 10, 2019.

(Continued)

*Primary Examiner* — Victor D Batson
*Assistant Examiner* — Matthew J Sullivan
(74) *Attorney, Agent, or Firm* — Burr & Brown, PLLC

(57) ABSTRACT

A device for moving a furniture part on an item of furniture, including a guide configured as an articulated lever releasably disposed on an assembly member of the device, which is assembled on the furniture part. The guide includes a securing member movably disposed on the articulated lever and capable of being positioned relative to the articulated lever. In a first position of the securing member a pivoting range of the guide is delimited by the securing member such that the guide in a closing movement is not capable of being moved from the opened position to the closed position. In a second position of the securing member the pivoting range of the guide is released such that the guide, in the closing movement from the opened position, reaches the closed position.

9 Claims, 4 Drawing Sheets

(56) References Cited

U.S. PATENT DOCUMENTS

| | | | | |
|---|---|---|---|---|
| 7,150,486 | B2 * | 12/2006 | Ichinose | B60P 1/26 296/51 |
| 7,966,699 | B2 * | 6/2011 | Dubach | E05D 7/123 16/386 |
| 8,007,026 | B2 * | 8/2011 | Scott | E05D 3/127 296/146.12 |
| 8,347,462 | B2 * | 1/2013 | Lowry | B60R 11/00 16/362 |
| 8,875,321 | B2 * | 11/2014 | Kanthasamy | A47C 17/17 297/354.12 |
| 9,526,327 | B1 * | 12/2016 | Lin | A47B 3/087 |
| 9,546,510 | B2 * | 1/2017 | Baghdasarian | E05D 11/1014 |
| 9,598,887 | B2 * | 3/2017 | Reed | E05D 7/0009 |
| 9,701,275 | B2 * | 7/2017 | Kim | B60R 21/34 |
| 10,118,587 | B2 * | 11/2018 | Czechtizky | B60R 21/38 |
| 10,145,157 | B2 * | 12/2018 | White | E05D 7/12 |
| 2009/0007383 | A1 * | 1/2009 | Lee | H04M 1/0237 16/362 |
| 2012/0079684 | A1 | 4/2012 | Tumler | |
| 2019/0061679 | A1 * | 2/2019 | Gabler | B60R 21/38 |
| 2019/0106918 | A1 | 4/2019 | Schmid | |
| 2019/0218840 | A1 * | 7/2019 | Hacault | B64D 29/06 |
| 2019/0241150 | A1 * | 8/2019 | Fredriksson | E05D 3/06 |
| 2019/0316398 | A1 * | 10/2019 | Kruedener | E05D 3/06 |
| 2019/0375369 | A1 * | 12/2019 | Hufen | B60R 21/38 |
| 2020/0165851 | A1 * | 5/2020 | Page | E05D 11/1007 |

OTHER PUBLICATIONS

German Search Report (Application No. 20 2018 102 089.7) dated Mar. 14, 2019.

* cited by examiner

DEVICE FOR MOVING A FURNITURE PART THAT IS RECEIVED ON A FURNITURE CABINET OF AN ITEM OF FURNITURE

This application claims the benefit under 35 USC § 119(a)-(d) of German Application No. 20 2018 102 089.7 filed Apr. 17, 2018, the entirety of which is incorporated herein by reference.

FIELD OF THE INVENTION

The present invention relates to a device for moving a furniture part that is received on a furniture cabinet of an item of furniture.

BACKGROUND OF THE INVENTION

Guides such as furniture hinges or flap fittings are known in the furniture sector in order to be able to move a furniture part relative to a furniture cabinet.

The guides have to meet various requirements; for example, an interior of the furniture cabinet, or of the movable furniture part, respectively, is to be rendered accessible by way of the guiding of the movement, in order to be able to accommodate items in the interior or to retrieve items from the latter.

An assembly of the furniture part on the guide in the case of known flap fittings is, in particular, associated with a comparatively high risk of injury by virtue of the comparatively strong spring effect.

SUMMARY OF THE INVENTION

It is an object of the present invention to improve a device for moving a furniture part that is received on a furniture cabinet of an item of furniture, in particular, to configure the device so as to be comparatively safe.

The present invention proceeds from a device for moving a furniture part that is received on a furniture cabinet of an item of furniture, wherein the device has a guide, wherein in a device assembled on the item of furniture the furniture part is movable by way of the guide from a closed position relative to the furniture cabinet to an opened position relative to the furniture cabinet and back, wherein the furniture part in the closed position assumes a position moved to a front side of the furniture cabinet, wherein one guide is configured as an articulated lever, wherein the articulated lever is configured so as to be capable of being releasably disposed on an assembly member of the device, wherein the assembly member is capable of being assembled on the furniture part.

The device is configured, for example, as a pivot fitting or as a flap fitting for a furniture part. The furniture part is present, for example, in the form of an upper flap of an item of furniture. The item of furniture, in particular, the furniture cabinet, is configured, for example, as a wall cupboard.

The furniture part in the closed position advantageously assumes a position moved to the maximum extent to a front side of the furniture cabinet. For example, an opening of the furniture cabinet is at least partially closed in the closed position. A spacing, in particular, a gap, is advantageously present between the furniture part and the furniture cabinet in the closed position. On account of the gap, an automatic touch/latch opening mechanism is implementable on the item of furniture, for example, the automatic touch/latch opening mechanism potentially forming part of the device, for example.

The core concept of the present invention can be seen in that the guide comprises a securing member, wherein the securing member is disposed so as to be movable on the articulated lever and is capable of being positioned relative to the articulated lever, wherein in a first position of the securing member a pivoting range of the guide is delimited by the securing member such that the guide in closing movement is not capable of being moved from the opened position to the closed position, wherein in a second position of the securing member the pivoting range of the guide is released such that the guide, in the closing movement from the opened position, reaches the closed position. On account thereof, closing the device in the assembled state on the furniture cabinet but in the case of an as yet non-assembled furniture part, and/or in the case of as yet non-assembled assembly member on the guide, is prevented, for example, on account of which any risk of injury by opening the device without an assembled furniture part is advantageously avoided.

In the first position of the securing member, a pivoting range of the guide is advantageously delimited by the securing member in such a manner that in the assembled state of the device on the item of furniture the assembly member and/or the furniture part in a closing movement do/does not reach the position moved to the maximum extent to the front side of the furniture cabinet, wherein in the second position of the securing member in the disposed state of the device on the item of furniture the assembly member and/or the furniture part in the closed position can reach the position moved to the maximum extent to the front side of the furniture cabinet.

The securing member is preferably capable of being moved relative to the articulated lever. For example, the securing member in an opening or closing movement of the guide is, in particular, conjointly moved with the articulated lever. In the assembled state of the guide on the assembly member, the securing member in the second position preferably does not protrude beyond an external periphery of the articulated lever in the direction of the assembly member. The periphery is, in particular, a periphery of a large flat side of the articulated lever, in particular, a periphery of a large flat side of an articulated arm of the articulated lever.

The guide advantageously comprises one first and one second articulated lever, wherein the first and the second articulated lever are connected to one another in an articulated manner, wherein the first articulated lever is configured in the manner of a sandwich having at least two articulated arms such that the second articulated lever is received so as to be movable between the two articulated arms of the first articulated lever. On account of the disposal in the manner of a sandwich, the articulated levers, or the articulated arms of the articulated levers, respectively, of the device are present so as to be comparatively slender. The design embodiment of at least one articulated lever in the manner of a sandwich moreover enables a comparatively central introduction of force of the articulated lever onto the housing.

It also proves advantageous that the securing member is disposed so as to be movable between the two articulated arms of an articulated lever. For example, the securing member is mounted so as to be movable on each articulated arm of the articulated lever. On account thereof, the securing member is advantageously present on the guide so as to be invisible to an observer.

It is moreover proposed that the securing member is disposed on the articulated lever so as to be, in particular, exclusively movable in a pivoting manner. The securing member is preferably disposed on the articulated lever so as to be, in particular, exclusively movable in a rotating manner. It is also imaginable that the securing member is present on the articulated lever so as to be, in particular, exclusively movable in a linear manner. In the case of the securing member being disposed on the articulated lever so as to be movable in a pivoting manner, the securing member can be present so as to be movable in a comparatively simple and easy manner by way of a leverage effect, for example.

The securing member is advantageously present as a lever element, for example in the form of a lever arm. For example, the lever element comprises a lever axis, wherein the lever element is disposed on the articulated lever so as to be movable in a pivoting manner by way of a pivot bearing, for example, wherein the pivot bearing is configured along the lever axis on the lever element. For example, the lever element along the lever axis extends across a lever length, wherein the pivot bearing is disposed on the lever element to as to be offset to a center of the lever length.

It is moreover advantageous that the guide has a spring member and the spring member is configured in such a manner that the securing member in a manner spring-loaded by the spring member is urged to the first position. For example, the securing member is present so as to be spring-loaded by the spring member. It is also conceivable that the guide is present in such a manner, in particular, the securing member is present in such a manner, that the force of gravity of the Earth moves the securing member to the first position.

For example, the guide is configured so as to be self-securing such that the guide is not capable of being moved to the closed position without an external intervention, for example, an intervention of the assembly member. On account thereof, the guide is secured in a self-acting manner such that the guide is not capable of being moved to the closed position without an external intervention, for example, by an intervention of the assembly member.

It is furthermore proposed that the spring member is configured as a leg spring. The spring member is preferably configured as a spring, for example, as a coil spring, a torsion spring, a leaf spring, in particular, as a leg spring.

In one advantageous design embodiment of the device, the securing member is disposed on a first articulated lever of the guide, and in the first position couples to a second articulated lever of the guide such that the guide in a closing movement is not capable of being moved from the opened position to the closed position. In particular, a relative movement of the first articulated lever in relation to the second articulated lever in the first position is delimited on account of the coupling of the securing member to the second articulated lever. For example, the securing member in the first position blocks a movement of the second articulated lever, in particular, relative to the first articulated lever.

It is moreover advantageous that a connection element is present on the assembly member, wherein the connection element is capable of being disposed on a locking mechanism, wherein the locking mechanism is configured on an articulated lever of the guide, wherein in the state of the guide connected to the assembly member the connection element urges the securing member from the first position to the second position such that the pivoting range of the guide is released, and the guide in the closing movement from the opened position reaches the closed position.

For example, the locking mechanism connects the two articulated arms of the first articulated lever to one another. One element of the locking mechanism is configured, for example, as a bolt, a pin, and/or a rivet. The connection element advantageously encompasses the element of the locking mechanism in the disposed state. The connection element advantageously possesses a receptacle. The receptacle is present, for example, in a C-shaped or U-shaped manner. The connection element by way of the receptacle preferably encompasses the element of the locking mechanism. For example, the element of the locking mechanism is, in particular, present on the first articulated lever so as to be exclusively movable in a linear manner. The locking mechanism comprises, for example, a spring element, and the spring element impinges the element of the locking mechanism with a spring force, and thus advantageously urges the element of the locking mechanism to a locking position with the connection element in the disposed state.

It is also proposed that the securing member comprises a latching element which in the first position latches to the second articulated lever. The latching element is configured in the manner of a hook, for example. The securing member is present so as to be integral, for example, wherein the securing member comprises the latching element. The latching element is configured, for example, on one end of the, in particular, elongate securing member.

It likewise proves advantageous that the securing member has a detent member on which the connection element acts in the state of the guide connected to the assembly member, wherein the detent member and the latching element are present so as to be mutually spaced apart. The securing member is present so as to be integral, for example, wherein the securing member comprises the detent member. The latching element is configured, for example, on a further end of the, for example, elongate securing member.

The latching element and/or the detent member are advantageously present so as to be integral on the securing member. The detent member and the latching element are advantageously configured so as to be mutually opposite. For example, the detent member is present on a second end of the securing member, and the latching element is present on a first end of the securing member.

It furthermore proves advantageous that the second articulated lever has a latching member which couples to the latching element of the securing member. The latching member is configured in the manner of a hook, for example. For example, the latching member is, in particular, present on the second articulated lever so as to project in the manner of a cam from the second articulated lever.

For example, the latching element in the first position engages behind the latching member of the second articulated lever. For example, the latching element in the first position engages behind the latching member of the second articulated lever in such a manner that any movement, in particular, any rotating movement, of the second articulated lever relative to the latching element or the securing member, in particular, in the movement plane of the guide, is blocked or disabled in a direction, in particular, in the closing direction, of the second articulated lever.

It is moreover proposed that the latching member and the second articulated lever are present so as to be integral.

It likewise proves advantageous that the device has an emergency opening mechanism. For example, the device in the closed state, in particular, in the case of a non-assembled furniture part and/or, for example, in the case of a non-assembled assembly member, is configured so as to be capable of being moved to an opened state by means of a mechanical intervention of a user. In the, for example, unforeseeable case of the functioning of the securing member failing and the guide without an assembled assembly member having been set to the closed state, the device is advantageously present in such a manner that the guide is capable of being moved back to an opened state by a user.

An item of furniture having a device for moving a furniture part that is received on a furniture cabinet of the item of furniture according to one of the embodiments described above is an advantageous design embodiment of the present invention.

BRIEF DESCRIPTION OF THE DRAWINGS

Further features and advantages of the present invention are explained in more detail by means of the exemplary embodiments that are schematically illustrated in the figures.

DETAILED DESCRIPTION OF THE INVENTION

Figure 1:
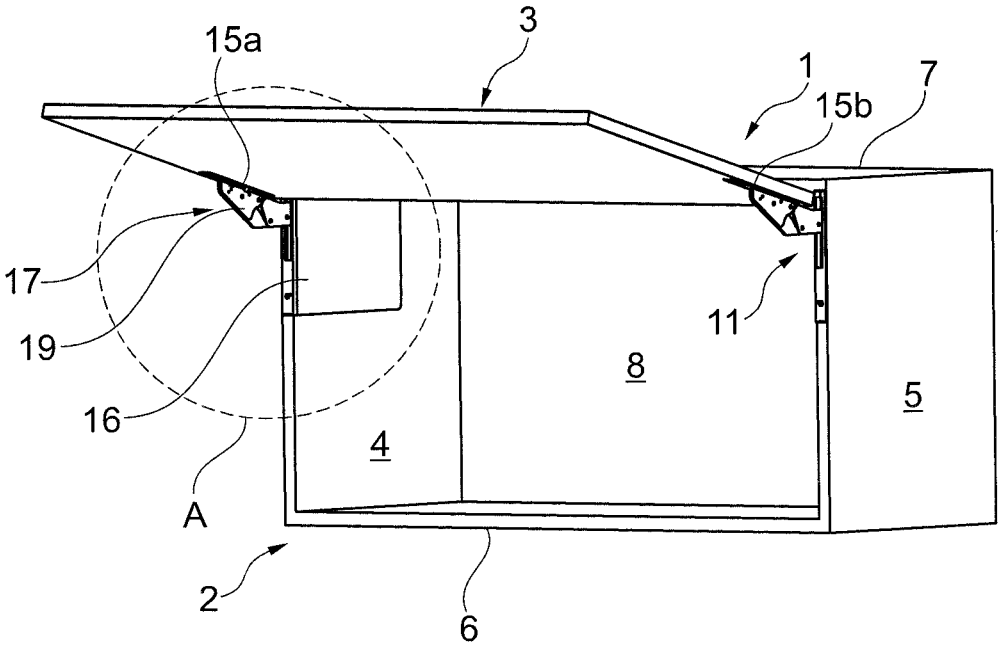
FIG. 1 shows a perspective view onto an item of furniture according to the present invention having a device according to the present invention for moving a furniture part illustrated as opened.
Figure 2:
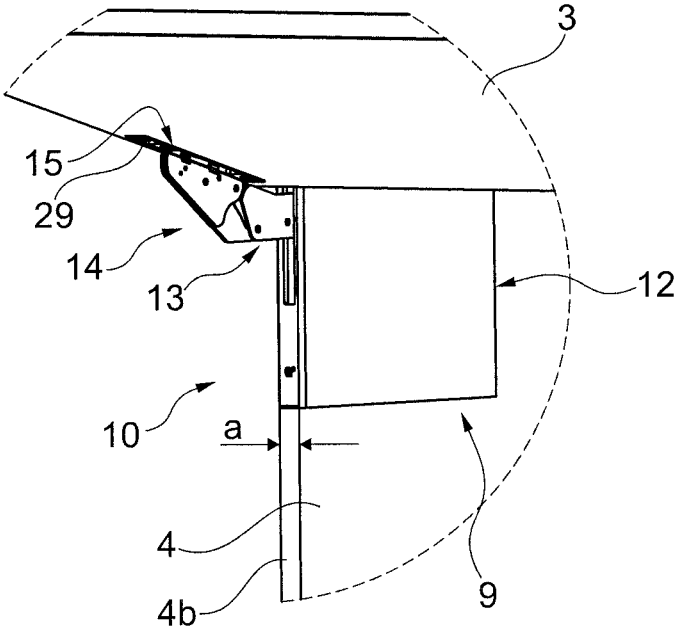
FIG. 2 shows the bordered region A in FIG. 1 in an enlarged illustration.

FIG. 1 shows in a perspective manner an item of furniture according to the present invention, or a wall cupboard 1 having a box-shaped furniture cabinet 2 and a furniture part received on the latter, the furniture part being configured in the manner of a board as an upper flap 3 which is shown in an opened position relative to the furniture cabinet 2.

The furniture cabinet 2 comprises two mutually opposite upright side walls 4 and 5 which at the bottom are connected to a lower base 6 and at the top to an upper base 7. The furniture cabinet 2 on the rear side is closed by a rear wall 8.

A movement device according to the invention which is designed as an upper flap fitting 9 is present for moving the upper flap 3 relative to the furniture cabinet 2 about a horizontal pivot axis, from the opened position shown in FIG. 1 to a closed position (not shown) that is moved toward a front side 4*b* on the front side of the furniture cabinet 2. The upper flap fitting 9 on the side wall 4 has a first fitting unit 10, and on the side wall 5 has a second fitting unit 11, the fitting units 10 and 11 being constructed in an identical manner but so as to be side-relevant in order to be disposed in a functionally appropriate manner on the respective side wall 4 or 5, respectively.

Each fitting unit 10 and 11 comprises a base unit 12, guide 13 having articulated levers and an assembly member in the form of assembly units which in each case comprise one assembly plate 15*a*, 15*b*. The base unit 12 is connected to the assembly plate 15*a*, 15*b* by way of a plurality of articulated levers which are mounted in an articulated manner and which are present as pivot arms of a pivot arm assembly 14, the assembly plate 15*a*, 15*b* being fixedly fastened to an internal side of the upper flap 3, for example, as to be sunk in material clearance.

Figure 3:
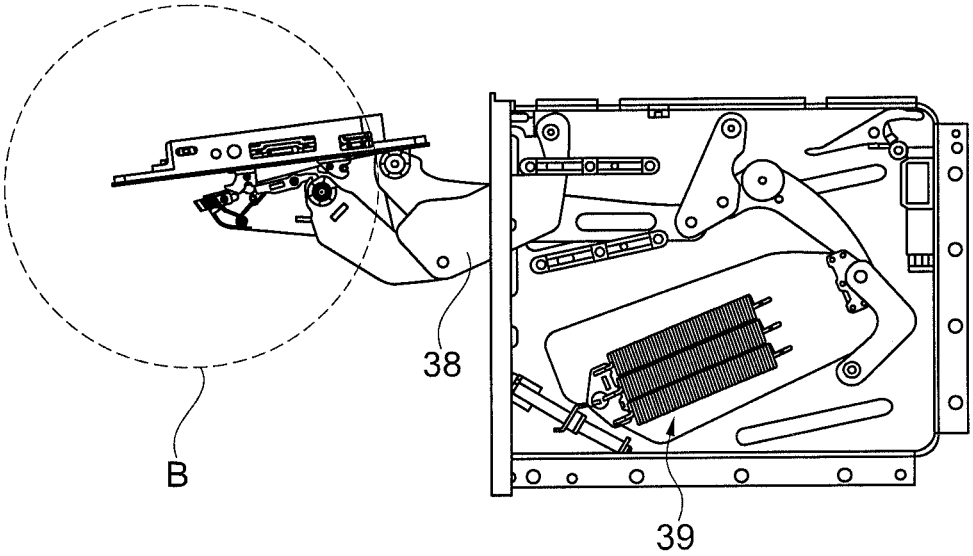
FIG. 3 shows a lateral illustration of the device, wherein a first assembly step of the assembly of an assembly member of the device on a guide of the device is shown in FIG. 3, wherein parts of the device are kept transparent for the sake of improved understanding.

The fitting unit 10 of the upper flap fitting 9 in FIG. 3 is shown in a state not yet assembled on the wall cupboard 1. Parts of the fitting unit 10 have been kept transparent for the sake of improved understanding, this including inter alia a lateral cover 16 as well as a lever arm of an articulated lever.

A first articulated lever 17 of the pivot arm assembly 14 advantageously comprises a first articulated arm 18 and a second articulated arm 19, wherein the second articulated arm 19 for the sake of an improved understanding of the device is kept transparent in FIG. 3. The two articulated arms 18, 19 of the first articulated lever 17 are advantageously present in an identical manner. It is also conceivable that the articulated arms 18, 19 are present in a mutually mirror-symmetrical manner.

Figure 4:
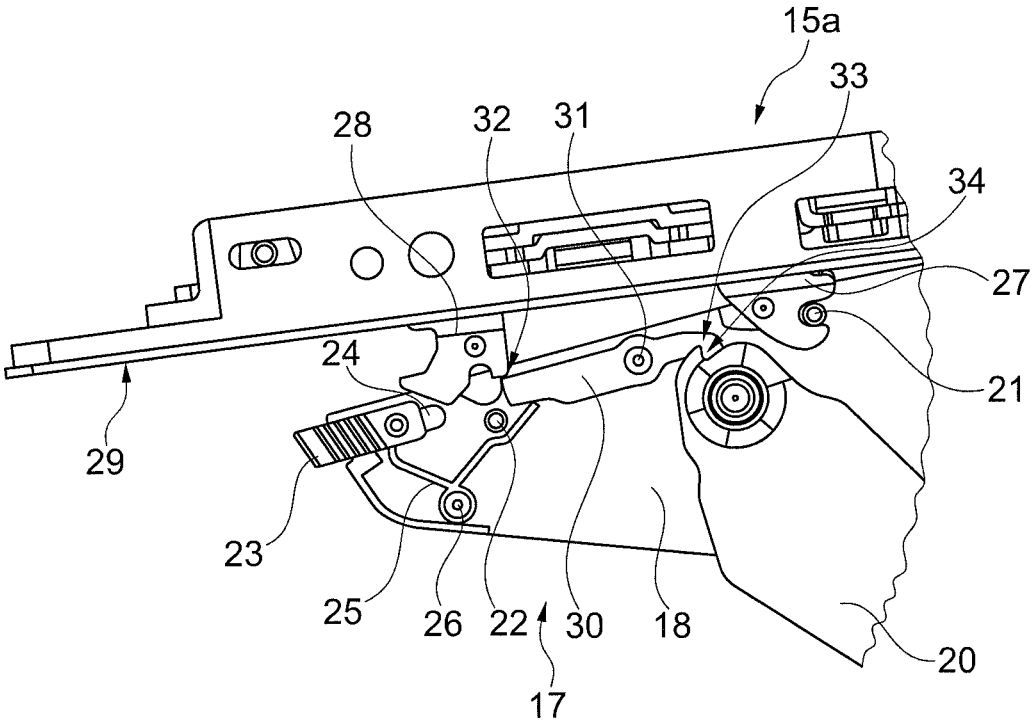
FIG. 4 shows the detail B according to FIG. 3 in an enlarged illustration.

A second articulated lever 20 of the pivot arm assembly 14 advantageously comprises a single articulated arm. The second articulated lever 20 is mounted so as to be capable of being moved between the two lever arms 18, 19 of the first articulated lever 17, for example. The first and the second articulated lever 17, 20 are preferably connected to one another in a movable manner (FIG. 4).

For example, the first articulated lever 17 comprises two locking members in the form of bolts 21, 22. The bolts 21, 22 are advantageously disposed on the articulated lever 17 so as to be mutually spaced apart. For example, the bolts 21, 22 are present so as to project on a lever arm 18, 19. For example, the lever arms 18, 19 are connected to one another by means of the bolts 21, 22. In particular, the lever arms 18, 19 are present so as to be mutually spaced apart by the bolts 21, 22.

Furthermore, locking mechanism in the form of a locking element 23 are configured on the first articulated lever 17, the locking element 23 being present on the first articulated lever 17 so as to be capable of being moved in a linear manner by means of a guide member in the form of a guide contour 24, for example. The guide contour 24 is configured, for example, in the manner of a slot, in particular, as a slot or as an elongate bore.

Moreover, a spring element in the form of a leg spring 25 is disposed on the first articulated lever 17, for example. The leg spring 25 is connected to the locking element 23, for example. The leg spring 25 is held at an assembly point 26 on the first articulated lever 17, for example.

Figure 6:
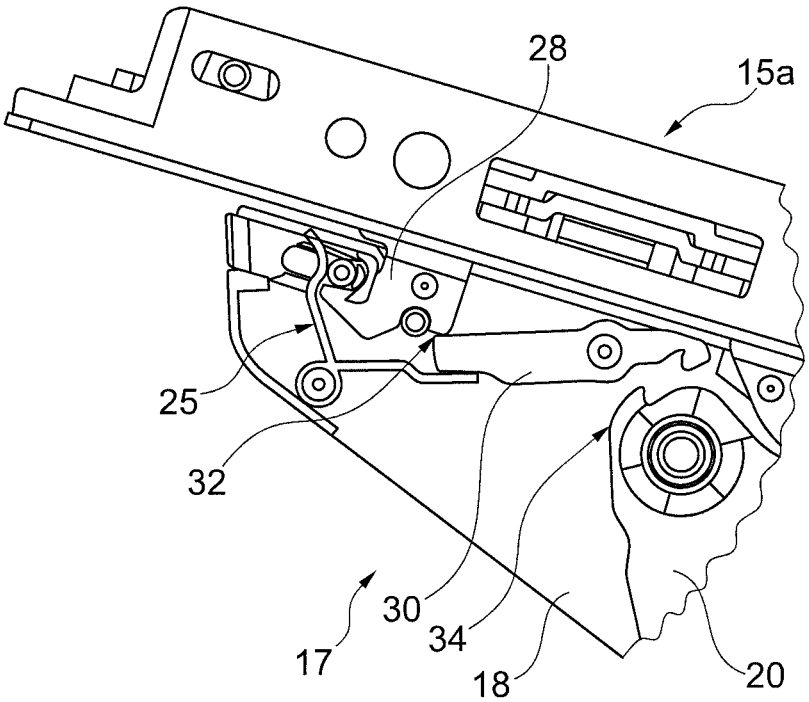
FIG. 6 shows the detail C according to FIG. 5 in an enlarged illustration.

For example, two mutually spaced apart connection elements 27, 28 are configured on the assembly plate 15*a*. The connection elements 27, 28 are configured so as to project from a surface 29 of the assembly plate 15*a*, for example. The connection elements 27, 28 are present in the manner of a hook, for example. In the disposed state of the assembly plate 15*a* on the first articulated lever 17, one connection element 27, 28 advantageously encompasses in each case one bolt 21, 22 (FIG. 6). For example, in an assembly procedure of the assembly plate 15*a* to the first articulated lever 17, a first connection element 27 is hooked to the bolts 21 by means of a pivoting movement.

A securing member in the form of a securing lever 30 is advantageously disposed on the first articulated lever 17. The securing lever 30 is mounted on the first articulated lever 17 so as to be capable of being rotated by way of a bearing 31, for example. The bearing 31 connects the first and the second articulated arm 18, 19, for example.

The securing lever 30 comprises, for example, on a first end a detent 32 and, for example, on a second end a latching element, for example, in the form of a recess 33.

The securing lever 30 is advantageously spring-loaded by the leg spring 25. The leg spring 25 engages on the securing lever 30 at the first end of the securing lever 30, for example. The second articulated lever 20 comprises a latching member in the form of a latching cam 34, for example. The latching cam 34 is present on the articulated lever 20 so as to be integral, for example. The leg spring 25 advantageously urges the securing lever 30 to the first position such that in the case of a corresponding relative position of the first and the second articulated lever 17, 20, for example, in the opened state of the pivot arm assembly 14, the securing lever 30 latches to the second articulated lever 20, or to the latching cam 34, respectively.

The latching cam 34 and the recess 33 are advantageously mutually adapted in such a manner that the securing lever 30 by way of the recess 33 can engage behind the latching cam 34 in a first position, as is shown in FIG. 4. On account thereof, any movement of the second articulated lever 20 relative to the first articulated lever 17 is blocked.

Figure 5:
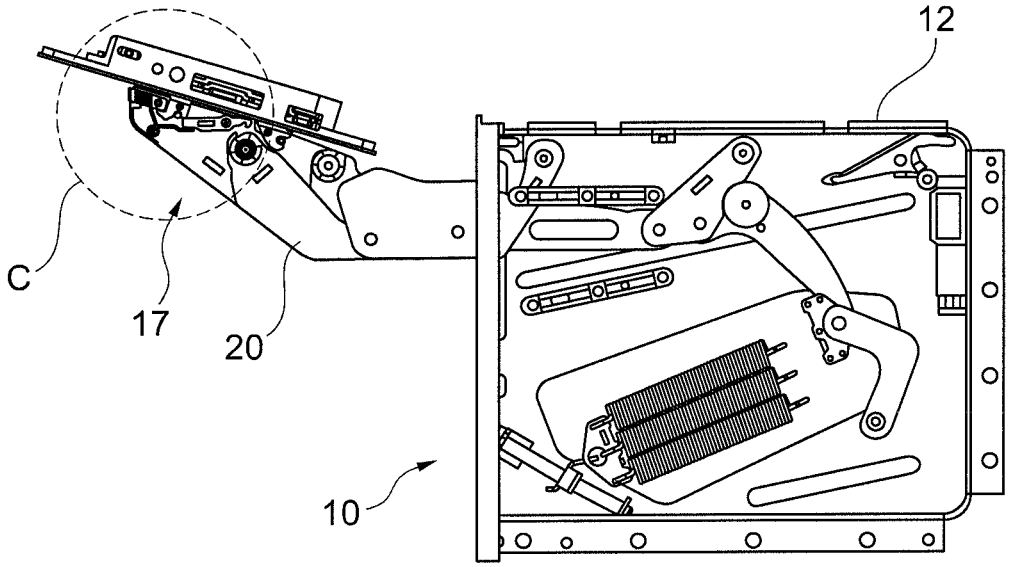
FIG. 5 shows a lateral illustration of the device, wherein a further assembly step of the assembly of an assembly member of the device on a guide of the device is shown in FIG. 5, wherein parts of the device are kept transparent for the sake of improved understanding.
Figure 7:
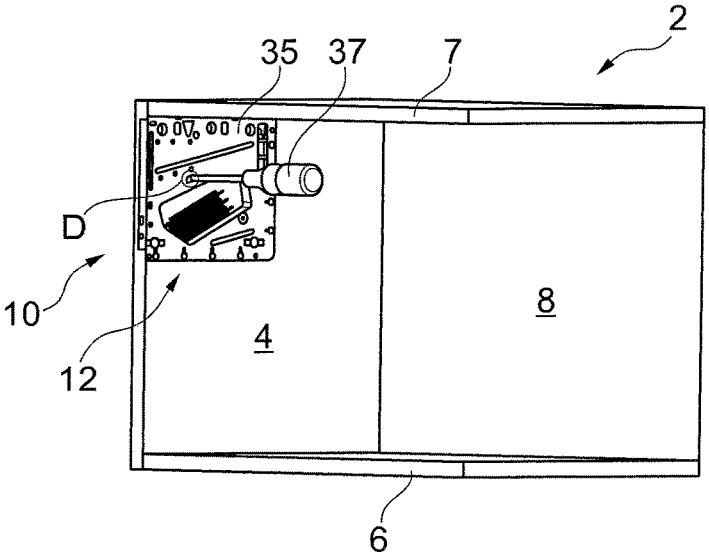
FIG. 7 shows a fragment of the furniture cabinet of the item of furniture having an assembled device, in a perspective illustration, wherein the device is situated in a closed position.

When assembling the assembly plate 15*a* on the first articulated lever 17 (FIGS. 4, 6), the connection element 28 impacts the detent 32 of the securing lever 30, for example, and counter to the spring effect of the leg spring 25 pushes the securing lever 30 to a second position (FIG. 6). In the second position, the securing lever 30 is advantageously present so as to be decoupled from the second articulated lever 20. On account thereof, a relative movement of the second articulated lever 20 in relation to the first articulated lever 17 is released, on account of which the pivot arm assembly 14 is capable of being moved in a closing movement from the opened position (FIGS. 1, 5) to a closed position (FIG. 7).

In the unlikely case of the pivot arm assembly 14 being situated in the closed position and the assembly plate 15*a* not being assembled on the first articulated lever 17 (FIG. 7), the fitting unit 10 advantageously comprises an emergency opening function in order for the pivot arm assembly 14 to be moved from the closed position to an opened position.

Figure 8:
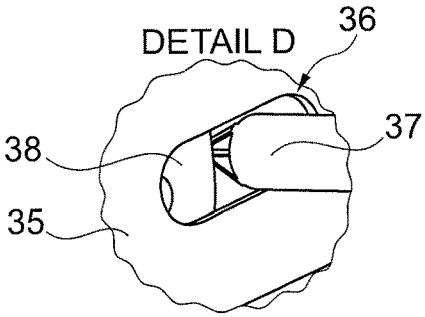
FIG. 8 shows the detail D according to FIG. 7 in an enlarged illustration.
Figure 10:
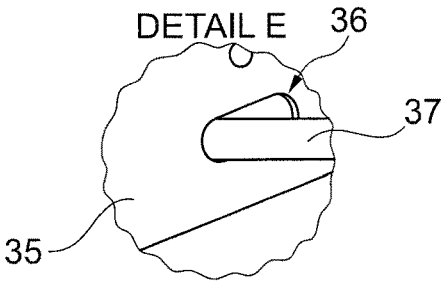
FIG. 10 shows the detail E according to FIG. 9 in an enlarged illustration.
Figure 9:
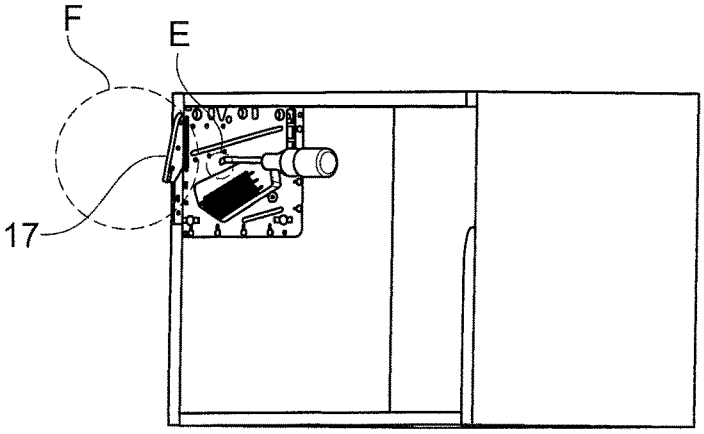
FIG. 9 shows a fragment of the furniture cabinet of the item of furniture having an assembled device, in a perspective illustration, wherein the device is situated in an opened position.
Figure 11:
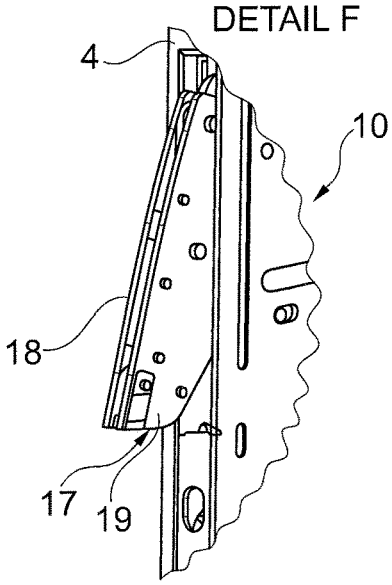
FIG. 11 shows the detail F according to FIG. 9 in an enlarged illustration.

To this end, the fitting unit 10, for example, on the base unit 12, has a functional opening 36 on a side wall 35. A technician can exert a force, for example, by means of a screwdriver 37, on a further articulated lever 38 of the pivot arm assembly 14 by way of the functional opening 36 (FIGS. 8, 10) such that the pivot arm assembly 14, counter to a spring force of the spring pack 39 of the pivot arm assembly 14, is capable of being moved to an opened position (FIGS. 9, 11) in which the technician can grip the first articulated lever 17 and can move the pivot arm assembly 14 to a further, in particular, completely, opened position. In this further movement, the pivot arm assembly 14 beyond a specific opened position of the pivot arm assembly 14 is supported by a force on account of the spring pack 39 and is moved to the completely opened position by the spring pack 39. By virtue of the support by the force of the spring pack 39, this movement of the pivot arm assembly 14 takes place in a comparatively rapid manner which means that there is a comparatively high risk of injury to the technician.

LIST OF REFERENCE SIGNS

1 Wall cupboard
2 Furniture cabinet
3 Upper flap
4 Side wall
4*b* Front side
5 Side wall
6 Lower base
7 Upper base
8 Rear wall
9 Upper flap fitting
10 Fitting unit
11 Fitting unit
12 Base unit
13 Guide
14 Pivot arm assembly
15*a*, 15*b* Assembly plate
16 Cover cap
17 Articulated lever
18, 19 Articulated arm
20 Articulated lever
21, 22 Bolt
23 Locking element
24 Guide contour
25 Leg spring
26 Assembly point
27, 28 Connection element
29 Surface
30 Securing lever
31 Bearing
32 Detent
33 Recess
34 Latching cam
35 Side wall
36 Functional opening
37 Screw driver
38 Articulated lever
39 Spring pack

The invention claimed is:

1. A device for moving a movable furniture part associated with a furniture cabinet, the device comprising:

an assembly member provided on a movable furniture part associated with a furniture cabinet;

a guide comprising at least one articulated lever that is releasably disposed on the assembly member, wherein the guide enables the movable furniture part to move from a closed position proximate a front side of the furniture cabinet to an opened position relative to the furniture cabinet and back, a securing member movably disposed on the articulated lever and positioned relative to the articulated lever, and a spring member configured such that the securing member is urged to a first position in a spring-loaded manner by the spring member; and a connection element provided on the assembly member and disposed in connection with a locking element of a locking mechanism, wherein the locking mechanism is configured on the articulated lever of the guide so that the locking element is movable in a linear manner, wherein the connection element urges the securing member from the first position to a second position such that the pivoting range of the guide is released, and the guide reaches the closed position from the opened position, and wherein the spring member is connected to the locking element such that the locking element is spring-loaded by the spring member;

wherein, in the first position of the securing member, a pivoting range of the guide is delimited by the securing member such that the guide is not capable of being moved from the opened position to the closed position, wherein, in the second position of the securing member, the pivoting range of the guide is released such that the guide is moved from the opened position to the closed position, and wherein, when the guide is connected to the assembly member, the locking element is urged to a locking position with the connection element by the spring-force of the spring member.

2. The device of claim 1, wherein the securing member is movably disposed on the articulated lever in a pivoting manner.

3. The device of claim 1, wherein the spring member is a leg spring.

4. The device of claim 1, wherein the securing member is disposed on a first articulated lever of the guide, and in the first position, the securing member couples to a second articulated lever of the guide such that the guide is not capable of being moved from the opened position to the closed position.

5. The device of claim 4, wherein the securing member comprises a latching element that latches to the second articulated lever in the first position.

6. The device of claim 5, wherein the securing member has a detent member on which a connection element acts when the guide is connected to the assembly member, wherein the detent member and the latching element are mutually spaced apart.

7. The device of claim 5, wherein the second articulated lever has a latching member that couples to the latching element of the securing member.

8. The device of claim 7, wherein the latching member is an integral part of the second articulated lever.

9. An item of furniture comprising the device of claim 1.

* * * * *